US006665517B2

(12) United States Patent
Brennan et al.

(10) Patent No.: US 6,665,517 B2
(45) Date of Patent: Dec. 16, 2003

(54) METHOD OF TRANSMITTING AUDIO SIGNALS TO MULTIPLE REMOTE RADIO STATIONS FROM A CENTRAL LOCATION

(75) Inventors: Christopher J. Brennan, Winnetka, IL (US); Scott A. Clifton, Naperville, IL (US)

(73) Assignee: One-On-One Sports, Inc., Northbrook, IL (US)

( * ) Notice: Subject to any disclaimer, the term of this patent is extended or adjusted under 35 U.S.C. 154(b) by 0 days.

(21) Appl. No.: 10/243,863

(22) Filed: Sep. 13, 2002

(65) Prior Publication Data

US 2003/0073454 A1 Apr. 17, 2003

Related U.S. Application Data

(63) Continuation of application No. 09/302,934, filed on Apr. 30, 1999, now abandoned.

(51) Int. Cl.[7] ..... H04H 7/00
(52) U.S. Cl. ..... 455/3.06; 455/3.01; 455/507
(58) Field of Search ..... 455/3.01–3.06, 455/507, 508; 725/36; 348/722; 381/6, 16

(56) References Cited

U.S. PATENT DOCUMENTS

2002/0177914 A1 * 11/2002 Chase ..... 700/94

* cited by examiner

*Primary Examiner*—Charles Appiah
*Assistant Examiner*—James Moore

(57) ABSTRACT

Radio signals which are broadcast by multiple local radio stations are controlled by a single central distribution location. The central distribution location can transmit both nationwide programming and local programming to each local station. Because the origin of the programming is centralized, staff and equipment at the local station can be minimized.

5 Claims, 1 Drawing Sheet

METHOD OF TRANSMITTING AUDIO SIGNALS TO MULTIPLE REMOTE RADIO STATIONS FROM A CENTRAL LOCATION

RELATED APPLICATION

This application is a continuation of U.S. Ser. No. 09/302,934, filed Apr. 30, 1999 now abandoned.

BACKGROUND

This invention relates to radio broadcasting. More particularly, the invention provides a method of transmitting audio signals from a central location to multiple radio stations in diverse geographic locations.

Radio stations conventionally broadcast a radio signal which can be received in a limited geographical area. For example, a radio station in Chicago can generally be heard only in the Chicago area, and a radio station in Los Angeles can be heard only in the Los Angeles area. Each local station requires its own staff and equipment for generating and transmitting the radio signal.

Radio networks operate by transmitting a common audio signal from a central location to multiple local radio stations in different geographic areas. The network signal can be transmitted by satellite or other conventional means. However, each local station which broadcasts the network signal still requires a staff and equipment for programming and distributing radio signals which are unique to that station. Such unique signals include, for example, non-network programming, legal ID news, traffic reporting, and advertising. Even if a local station broadcasted the network signal for 24 hours a day, the local station would still need staff and equipment for broadcasting advertising and other information which is directed to the local audience.

The 1996 Communication Act eliminated "same-market-origination" for local radio programming.

SUMMARY OF THE INVENTION

The invention provides a method of nationwide or worldwide multi-station (radio) distribution of programming, production elements (promotions, liners, id's etc.), trafficking, billing and invoicing functions from a centralized distribution location. The system provides a low-cost program distribution alternative for multi-station operators in individual markets at no incremental cost to receive network, syndicated or local programming, from a centralized distribution source. This system of distribution can be set up for multi-station groups which own stations in different locations nationwide or for network or syndication operations for efficient delivery of their product to multiple station group owners with stations requiring nationwide programming integrated with localized programming from the same distribution system.

In one aspect of the invention, all programming staff and equipment can be eliminated at the local stations. All that is reqired at each station is equipment for receiving the signal from the central distribution source and equipment for broadcasting the signal.

In another aspect of the invention, the signal for a local station can be customized in real time by sending an audio signal, e.g., a traffic report or a play-by-play report of an athletic event, from the local area to the central station. The central station then transmits the signal to the local station for broadcast to the local area.

DESCRIPTION OF THE DRAWING

The invention will be explained in conjunction with an illustrative embodiment shown in the accompanying drawing, in which.

DESCRIPTION OF SPECIFIC EMBODIMENTS

Figure 1:
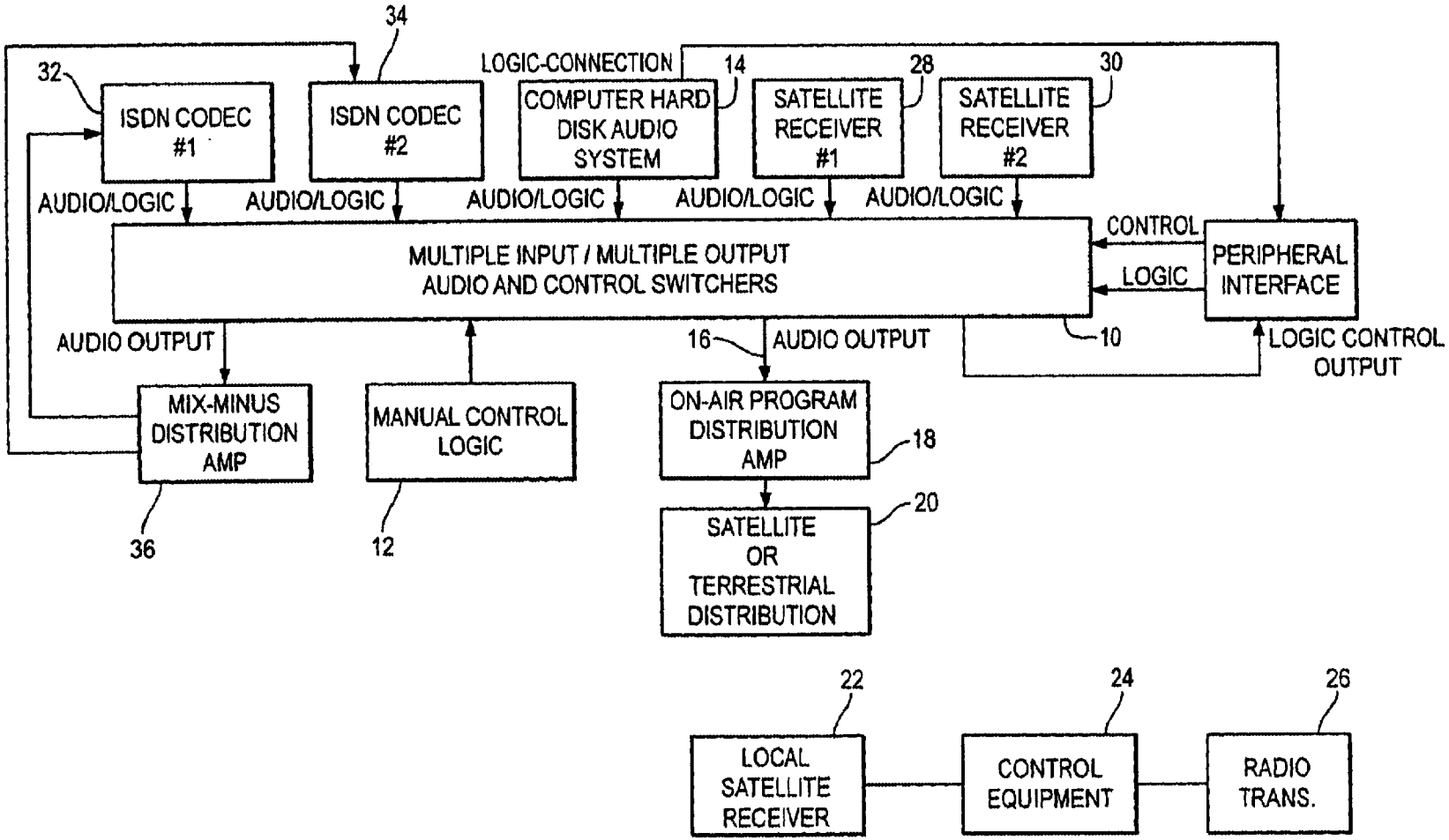
FIG. 1 is a diagrammatic illustration of the invention.

The method of the invention uses well known and conventional equipment to prepare, control, and broadcast radio programming. For example, the central distribution station includes an equipment rack and various equipment for each local radio station. Audio signals are distributed to an audio switcher in each rack. Along with the audio from the various sources comes signaling information to remotely signal the computer in each rack to perform an appropriate command or function, i.e., play commercials, liners, stations identification, or any audio or function unique to that station. The computers are automatically controlling events that are pre-programmed into a schedule or log, which is compiled by the traffic department of the central station. Each computer is independently capable of automatically selecting the audio to be transmitted or the source from which it will be obtained. This is called automatic source selection.

An example of automatic source selection would be the selection of a local traffic report, a local play-by-play broadcast, or any other audio program source which is transmitted to only one of the local stations. These types of broadcasts can e received at the central station by an audio CODEC which is connected to an Integral Switch Digital Network (ISDN) line for dial-up access, by satellite, or by any other wired or un-wired methods. The computer, in addition to controlling the audio selections and signaling sources, plays commercials, promotional announcements, positioning statement, legal ID's or other pre-recorded audio elements.

The audio switcher output is connected to an individual channel on a satellite uplink for the main delivery to the local station. The satellite link can be backed up by an ISDN line. A receiver at the local station receives the signal from the central station, and a transmitter at the local station broadcasts the signal.

This configuration of equipment allows local radio stations in, e.g., Los Angeles, New York, Boston, and Chicago, to be programmed and controlled from a common point located in, e.g., Chicago. The capabilities of the design allow for most functions of conventional broadcasting or audio distribution to be used anywhere at anytime without limitation. Because the origin of programming is centralized, staffing at the local radio stations is kept to a minimum allowable by FCC rules and regulations. This allows for maximum operating efficiency and ability to provide competitive major market programming i any market, large or small.

Referring to the drawing, the numeral 10 refers generally to a plurality of racks of conventional radio programming equipment which includes one or more multiple input and output audio and control switchers. The racks 10 receive input from manual control logic 12 and from computer hard disc audio system 14 and also from items 28, 30, 32, and 34.

The control equipment in the central location which controls a particular local station can also select live audio or recorded signals which are unique to that local station. For example, a local audio signal such as a local traffic report or a local talk show can be transmitted by satellite transmitter from the local area to satellite receivers 28 or 30 at the central station. Alternatively, the local signal can be transmitted to the central station by ISDN-CODEC links 32 or 34.

The audio signals which are controlled by each rack includes prerecorded signals which are unique to the local station which is represented by that rack, e.g., commercials, station identifications, etc. The audio signals can also include live or recorded signals which are broadcast to a plurality or all of the local stations, e.g., a national talk show, the play-by-play of an event, commercials which are suitable for widespread distribution, etc.

The foregoing programming equipment for each rack is conventional and well known, and a detailed description is unnecessary. The uniqueness of the inventive method is that multiple local stations in diverse geographic areas can be programmed and controlled from one central location.

The control equipment for each station controls which audio signal is selected for broadcast and sends an audio output signal 16 to an on-air program distribution amplifier 18. The output signal is transmitted to the local station by satellite transmitter 20. Alternatively, the output signal can be transmitted to the local station by wires, land lines, or other terrestrial distribution methods. If satellite distribution is used, a back-up ground link can be provided by an ISDN or other land line in the event that the satellite signal is interrupted.

The local station receives the signal, e.g., by satellite receiver 22. The signal is processed by conventional control equipment 24 and transmitted to the broadcast area of the station by radio transmitter 26.

The control equipment at the central station transmits the local signal to the local radio station by satellite or terrestrial distribution 20, and the local station broadcasts the signal. Because the radio signal which is broadcast by the local station is controlled by the central station, programming staff and studio equipment is not required at the local station even though the local station is broadcasting a signal which is unique to that local area and which may originate from that area.

The unique local audio signal need not originate from the local station. For example, an audio play-by-play signal for a local sporting event or an audio signal for a local talk show can be transmitted to the central station directly from the site of the event.

The Mix-Minus Distribution Amp 36 is used for live broadcasting.

The foregoing method of broadcasting or distribution allows for a common point of control for any number of audio sources which are distributed to one or more remote locations. The controller is capable of receiving or controlling signals from remote or local origins.

While in the foregoing specification a detailed description of specific embodiments of the invention was set forth for the purpose of illustration, it will be understood that many of the details hereingiven can be varied considerably by those skilled in the art without departing from the spirit and scope of the invention.

We claim:

1. A method of transmitting audio signals from a central distribution station to multiple radio stations in different geographical areas comprising the steps of:

a) preparing a separate audio program for each of the radio stations at the central station, said preparing step including the steps of:
   i) supplying a plurality of audio signals to a separate audio switcher for each of the radio stations,
   ii) actuating the audio switcher for each radio station to select audio signals for the audio program for that radio station, b) transmitting the separate audio program for each radio station from the central station to that radio station, c) broadcasting the separate audio program for each radio station from that radio station without changing the audio program at the radio station.

2. The method of claim 1 in which said step of preparing a separate audio program for each of the radio stations comprises selecting some audio signals which are common for all of the radio stations and selecting other audio signals which are unique for each radio station.

3. The method of claim 1 including the steps of transmitting a local signal from the geographical area of one of the radio stations to the central station and including said local signal in the audio program for said one radio station.

4. The method of claim 1 in which the audio program for each radio station consists of a set of audio signals which are broadcast only by that radio station and not by other radio stations.

5. The method of claim 1 in which said step of preparing a separate radio program for each radio station includes using separate programming equipment for each radio station which selects the audio signals which comprise the radio program.

* * * * *